US006478246B2

(12) United States Patent
Fahringer

(10) Patent No.: US 6,478,246 B2
(45) Date of Patent: Nov. 12, 2002

(54) PAPER TOWEL DISPENSER SYSTEM

(76) Inventor: Thomas L. Fahringer, 105 Locust Dr., Brandon, FL (US) 33511-8018

( * ) Notice: Subject to any disclaimer, the term of this patent is extended or adjusted under 35 U.S.C. 154(b) by 82 days.

(21) Appl. No.: 09/735,986

(22) Filed: Dec. 13, 2000

(65) Prior Publication Data

US 2002/0070308 A1 Jun. 13, 2002

(51) Int. Cl.[7] ..... B65H 23/06
(52) U.S. Cl. ..... 242/423.2; 242/423.1
(58) Field of Search ..... 242/423.2, 423.1, 242/597.7, 597.4

(56) References Cited

U.S. PATENT DOCUMENTS 1,057,614 A * 4/1913 Bedell et al. ..... 242/423.2
1,394,177 A * 10/1921 Jones ..... 403/247
1,665,272 A * 4/1928 Myers ..... 242/423.1
3,941,320 A * 3/1976 Strunk ..... 242/486.2
4,738,385 A * 4/1988 Bell ..... 225/106
5,135,179 A * 8/1992 Morano ..... 242/423.1
6,092,758 A * 7/2000 Gemmell ..... 242/596.4

FOREIGN PATENT DOCUMENTS

DE 3613988 A1 * 3/1987
DE WO 87/02231 * 4/1987

* cited by examiner

*Primary Examiner*—Donald P. Walsh

(57) ABSTRACT

A base has a horizontal top face with an aperture, a bottom face, a central vertical support with projections extending from each end. The projection of the bottom end is coupled with the central aperture of the base. A knob assembly has a lower portion with guide posts, a braking section and a downwardly projecting member with a recess with grooves. Between the upper and lower portions is a coil spring.

4 Claims, 3 Drawing Sheets

PAPER TOWEL DISPENSER SYSTEM

BACKGROUND OF THE INVENTION

1. Field of the Invention

The present invention relates to a paper towel dispenser system and more particularly pertains to unreeling out paper towels in an efficient manner through a selective braking force.

2. Description of the Prior Art

The use of paper supporting systems is known in the prior art. More specifically, paper supporting systems previously devised and utilized for the purpose of making the dispensing of paper more efficient are known to consist basically of familiar, expected, and obvious structural configurations, notwithstanding the myriad of designs encompassed by the crowded prior art which has been developed for the fulfillment of countless objectives and requirements.

By way of example, note U.S. Pat. No. 5,605,304 issued Feb. 25, 1997 to Ahern relating to a paper towel dispenser. In addition, U.S. Pat. No. 4,235,389 issued Nov. 25, 1980 to Ness discloses a paper towel holder and the like. Lastly, U.S. Pat. No. 4,235,389 issued Jul. 18, 1989 to Lemoine discloses a vertical holder for perforated paper toweling or other material.

While these devices fulfill their respective, particular objectives and requirements, the aforementioned patents do not describe a paper towel dispenser system that allows unreeling out paper towels in an efficient manner through a selective braking force to preclude over reeling.

In this respect, the paper towel dispenser system according to the present invention substantially departs from the conventional concepts and designs of the prior art, and in doing so provides an apparatus primarily developed for the purpose of precluding unreeling out excess paper towels in an efficient manner through a selective braking force.

Therefore, it can be appreciated that there exists a continuing need for a new and improved paper towel dispenser system which can be used for the proper unreeling out paper towels in an efficient manner through a selective braking force. In this regard, the present invention substantially fulfills this need.

SUMMARY OF THE INVENTION

In view of the foregoing disadvantages inherent in the known types of paper towel dispensers now present in the prior art, the present invention provides an improved paper towel dispenser system. As such, the general purpose of the present invention, which will be described subsequently in greater detail, is to provide a new and improved paper towel dispenser system and method which has all the advantages of the prior art and none of the disadvantages.

To attain this, the present invention essentially comprises a paper towel dispenser system for unreeling out paper towels in roll form supported by a hollow cylindrical core in an efficient manner through a selective braking force. The system comprises a base formed in a circular disk configuration with a horizontal top face and a horizontal bottom face and a tapered side edge there between. The top face of the base further has a vertical threaded central aperture and a radial vertical offset threaded aperture near the side edge. The bottom face has a plurality of rubber feet equally spaced from each other to raise the base above a support surface. Secondly, the system comprises a central vertical support bar of a long cylindrical configuration. This support bar has a top end and a bottom end with a threaded projection extending from each end. The threaded projection of the bottom end are screwably coupled with the central aperture of the top face of the base. Thirdly, the system includes a knob assembly which has a lower portion of a cylindrical configuration. The lower portion has a radius similar to that of the central support bar and has a pair of horizontal guide posts extending laterally from a side face. It also has a retaining post protruding upwardly from a top face. The lower portion further has a threaded aperture on the bottom face adapted to be screwably coupled to the top end threaded projection of the central support bar. The knob assembly also has an upper portion having a generally spherical outer surface with a disk shaped braking section adjacent to the lower edge of the spherical outer surface adapted to contact the end of a core of paper towels supported on the central support bar. The upper portion also has a tapered downwardly projecting member which further extends from the braking section to provide lateral support to the core. The upper portion next has a cylindrical recess for receiving the bottom portion, such recess has a pair of axially extending vertical longitudinal grooves along its inner face spaced to slidably receive the guide posts of the lower portion. Finally the knob assembly includes a coil spring between the upper and lower portions that abuts an inner face of the cylindrical recess of the upper portion and coincides with the retaining post of the lower portion. The spring is adapted to apply a force to the upper portion to thereby retain the braking section out of contact with the core of the roll of paper towels during the unreeling out of paper towels until a user depresses the upper portion of the knob assembly to apply a braking force to the core of the paper towels to preclude over unreeling out of the paper towels. Finally, the system includes a second support bar having a smaller radius and height as compared to the central support bar. The support bar has a flush top end with the a second treaded portion extending from the bottom end is adapted to screwably couple to the radial aperture of the base.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paper towel dispenser system which has all of the advantages of the prior art paper supporting systems and none of the disadvantages.

It is another object of the present invention to provide a new and improved paper towel dispenser system which may be easily and efficiently manufactured and marketed.

It is further object of the present invention to provide a new and improved paper towel dispenser system which is of durable and reliable constructions.

An even further object of the present invention is to provide a new and improved paper towel dispenser system which is susceptible of a low cost of manufacture with regard to both materials and labor, and which accordingly is then susceptible of low prices of sale to the consuming public, thereby making such paper towel dispenser system economically available to the buying public.

Even still another object of the present invention is to provide a paper towel dispenser system for unreeling out paper towels in an efficient manner and for precluding the over unreeling of the roll of paper towels through a selective braking force at the discretion of the user.

Lastly, it is an object of the present invention to provide a paper towel dispenser system for unreeling out paper towels in roll form supported by a core in an efficient manner through a selective braking force. The system first comprises a base configuration with a horizontal top face and a horizontal bottom face and has a side edge there between. The top face of the base further has a vertical central aperture. The system also include a central vertical support bar of a long cylindrical configuration having projections extending from each end. The projection of the bottom end is coupled with the central aperture of the top face of the base. Finally, the system includes a knob assembly that has a lower portion having a pair of horizontal guide posts and is coupled to the top end projection of the central support bar. The knob assembly also has an upper portion having a braking section adapted to contact the end of a core of paper towels supported on the central support bar and a downwardly projecting member which further extends from the braking section. The upper portion also has a cylindrical recess extending into a bottom of the upper portion, such recess has a pair of axially extending vertical longitudinally grooves along its inner face spaced to slidably receive the guide posts of the lower portion. Lastly the knob assembly includes a coil spring between the upper and lower portions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
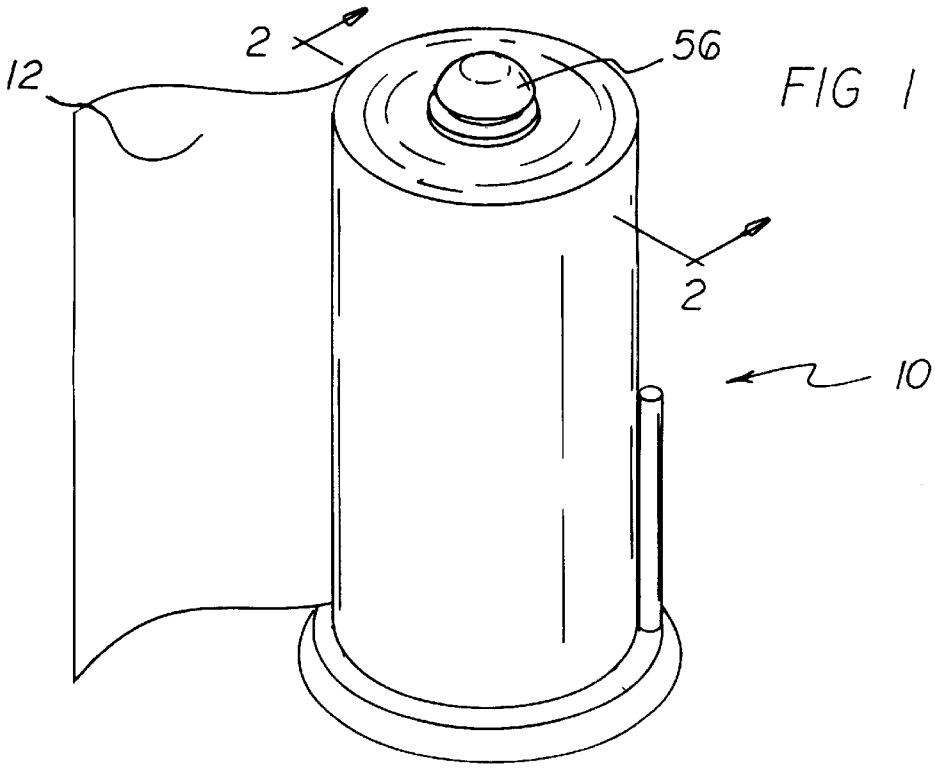
FIG. 1 is perspective view of the paper towel dispenser system constructed in accordance with the principles of the present invention.
Figure 2:
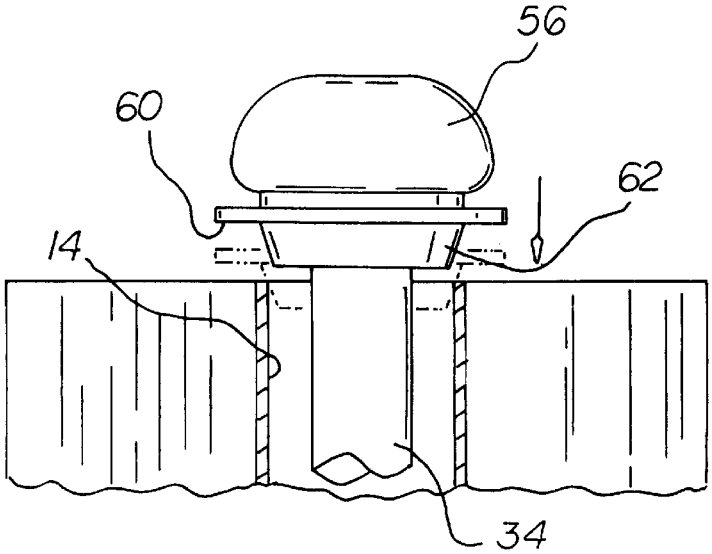
FIG. 2 is an enlarged side elevational view of the knob assembly shown in FIG. 1.
Figure 3:
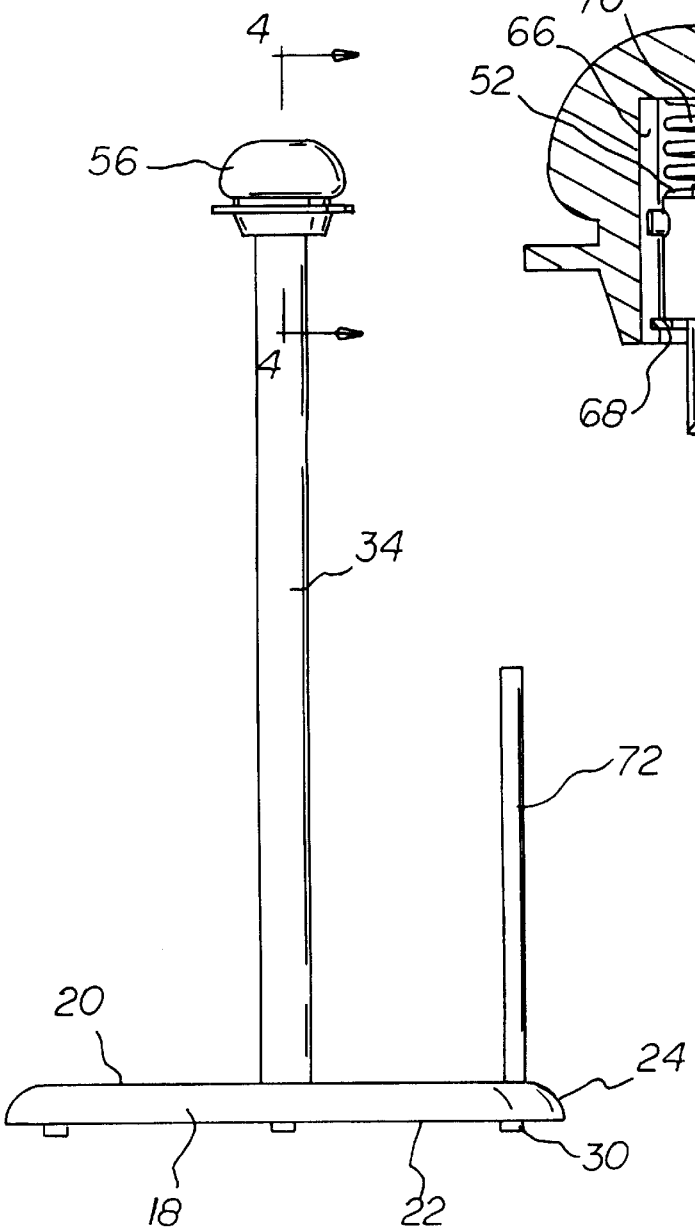
FIG. 3 is a side elevational view of the system of the FIG. 1 but with the roll of paper towels removed.
Figure 4:
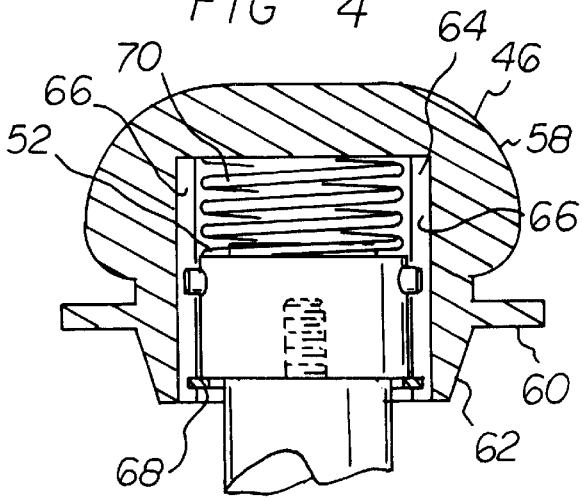
FIG. 4 is a cross sectional view taken along line 4—4 of FIG. 3.
Figure 5:
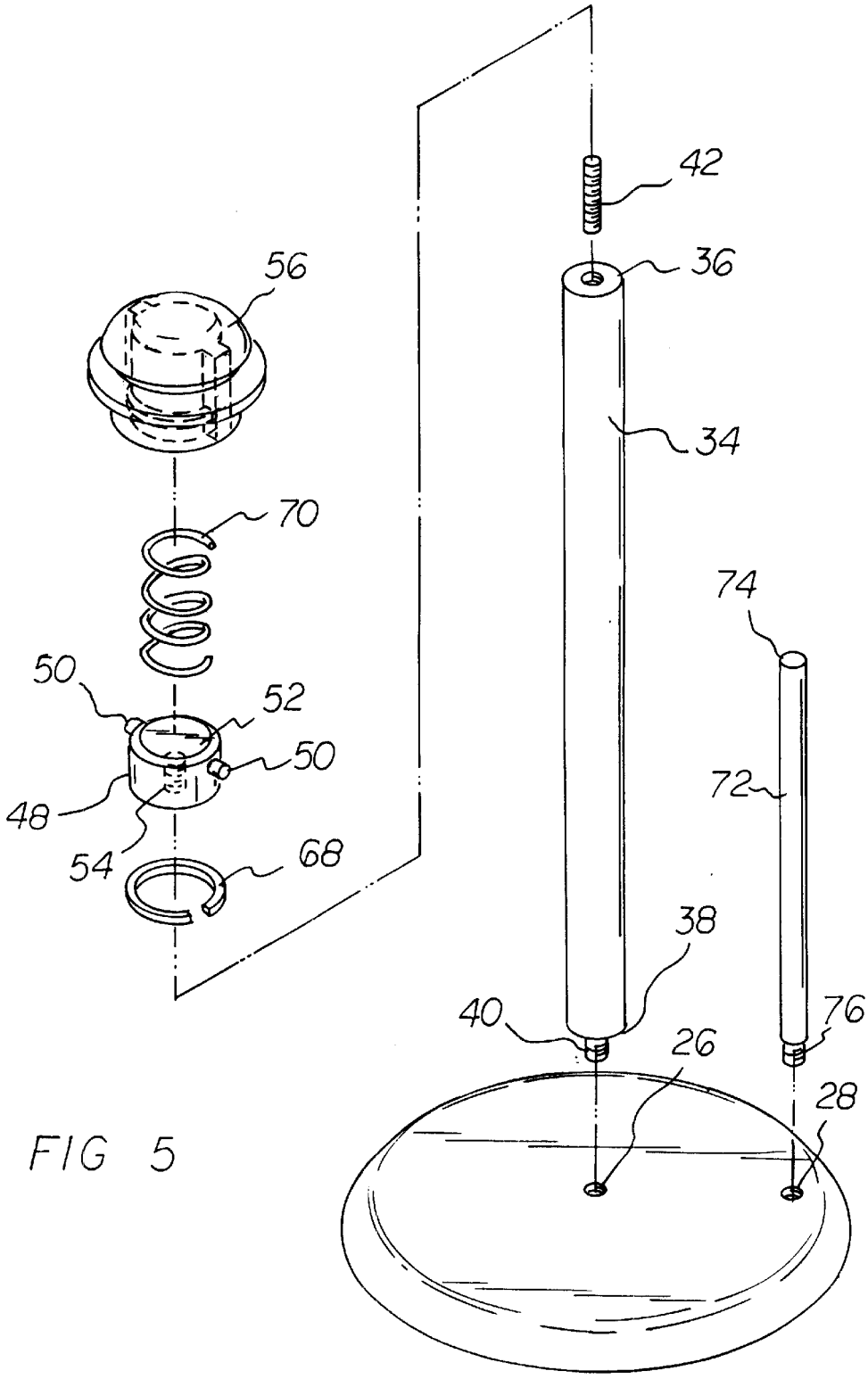
FIG. 5 is an exploded perspective view of the paper towel dispenser system of the present invention.

With reference now to the drawings, and in particular to FIGS. 1 through 5 thereof, the preferred embodiment of the paper towel dispenser system embodying the principles and concepts of the present invention and generally designated by the reference numeral 10 will be described.

The present invention, the paper towel dispenser system 10 is comprised of a plurality of components. Such components in their broadest context include a base, a support bar and a knob assembly. Such components are individually configured and correlated with respect to each other so as to attain the desired objective.

The paper towel dispenser system 10 functions for unreeling out paper towels 12 in roll form supported by a hollow cylindrical core 14 in an efficient manner through a selective braking force. The paper of the roll is normally perforated at spaced locations along its length to assist a user in tearing off a preselected length of paper in a more convenient manner.

The system comprises a base 18 which is formed in a circular disk configuration with a horizontal top face 20 and a horizontal bottom face 22 and a tapered side edge 24 there between. The top face of the base further has a vertical threaded central aperture 26 and a radial vertical offset threaded aperture 28 located near the side edge. The bottom face has a plurality of feet 30, preferably fabricated of rubber, equally spaced from each other to raise the base above a support surface such as a kitchen, bath room, work shop or the like.

Next provided is a knob assembly 46 which has a lower recess portion 48 of a cylindrical configuration. The lower recess portion has a radius similar to that of the central support bar and has a pair of horizontal guide posts 50 extending laterally from a side face. The guide posts may preferably be the ends of a transversely extending dowel. It also has a retaining post 52 protruding upwardly from a top face. The lower portion further has a threaded aperture 54 in the lower recess portion adapted to be screwably coupled to the top end threaded projection of the central support bar.

The knob assembly also has an upper portion 56 having a generally spherical outer surface 58 with a disk shaped braking section 60 adjacent to the lower edge of the spherical outer surface adapted to contact the end of a core of paper towels supported on the central support bar. The upper portion also has a tapered downwardly projecting member 62 which further extends from the braking section to provide lateral support to the core. The upper portion next has a cylindrical recess 64 for receiving the bottom portion, such recess has a pair of axially extending vertical longitudinal grooves 66 along its inner face spaced to slidably receive the guide posts of the lower portion. A snap ring collar 68 is provided at the lower extent of the upper portion to retain the glide posts within the grooves.

The knob assembly also has an upper portion 56 having a generally spherical outer surface 58 with a disk shaped braking section 60 adjacent to the lower edge of the spherical outer surface adapted to contact the end of a core of paper towels supported on the central support bar. The upper portion also has a tapered downardly projecting member 62 which further extends from the braking section to provide lateral support to the core. The upper portion next has a cylindrical recess 64 for receiving the bottom portion, such recess has a pair of axially extending vertical longitudinally grooves 66 along its inner face spaced to slidably receive the guide posts of the lower portion. A snap ring collar 68 is provided at the lower extent of the upper portion to retain the guide posts within the grooves.

Finally the knob assembly includes a coil spring 70. Such spring is located between the upper and lower portions, The spring abuts an inner face of the cylindrical recess of the upper portion and coincides with the retaining post of the lower portion. The spring is adapted to apply an upward force to the upper portion to thereby retain the braking section out of contact with the core of the roll of paper towels during the unreeling out of paper towels until a user depresses the upper portion of the knob assembly to apply a braking force to the core of the paper towels and thus abate over unreeling and dispensing of unwanted paper towels.

Finally, the system includes, as an option, a second support bar 72 having a smaller radius and height as compared to the central support bar. The support bar has a flush top end 74 with the a second treaded portion 76 extending from the bottom end which is adapted to screwably couple to the radial aperture of the base. This second support bar functions to hold the free end of a roll of supported paper towels in a convenient location for being grasped by a user prior to pulling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paper towel dispenser system for unreeling out paper towels in roll form supported by a core in a efficient manner through a selective braking force, comprising in combination;

a base formed as a circular disk configuration with a horizontal top face and a horizontal bottom face and having a tapered side edge there between, the top face of the base further having a vertical threaded central aperture and a vertical, radially offset threaded aperture near the side edge, the bottom face having a plurality of rubber feet equally spaced from each other to raise the base above a support surface;

a central vertical support bar of a long cylindrical configuration having a top end and a bottom end with a threaded projection extending from each end, the threaded projection of the bottom end being screwably coupled with the central aperture of the top face of the base;

a knob assembly having a lower portion with a lower recess of a cylindrical configuration having a radius similar to that of the central support bar and having a pair of horizontal guide posts extending laterally from a side face and with a retaining post protruding upwardly from the top face, the lower portion further having a threaded aperture in the lower recess adapted to be screwably coupled to the top end treaded projection of the central support bar, the knob assembly also having an upper portion having a generally spherical outer surface with a disk shaped braking section adjacent to the lower edge of the spherical outer surface adapted to contact the end of a core of paper towels supported on the central support bar and a tapered downardly projecting member which further extends from the braking section to provide lateral support to the core, the upper portion also having a cylindrical recess extending into a bottom of the upper portion, such recess having a pair of axially extending vertical longitudinally grooves along its inner face spaced to slidably receive the guide posts of the lower portion, and a coil spring between the upper and lower portions that abuts an inner face of the cylindrical recess of the upper portion and coincides with the retaining post of the lower portion, the spring adapted to apply a force to the upper portion to thereby retain the braking section out of contact with the core of the roll of paper towels during the unreeling out of paper towels until a user depresses the upper portion of the knob assembly to apply a braking force to the core of the paper towels; and a second support bar having a smaller radius and height as compared to the central support bar and having flush top end with the a second treaded portion extending from the bottom end being adapted to screwably couple to the radial aperture of the base.

2. A paper towel dispenser system comprising:

a base formed as a disk configuration with a horizontal top face and a horizontal bottom face and having a side edge there between, the top face of the base further having a vertical central aperture;

a central vertical support bar of a long cylindrical configuration having projections extending from each end, the projection of the bottom end coupled with the central aperture of the top face of the base; and a knob assembly having a lower portion having a pair of horizontal guide posts and being coupled to the top end projection of the central support bar, the knob assembly also having an upper portion having a braking section adapted to contact the end of a core of paper towels supported on the central support bar and a downwardly projecting member which further extends from the braking section, the upper portion also having a cylindrical recess extending into a bottom of the upper portion, such recess having a pair of axially extending vertical longitudinally grooves along its inner face spaced to slidably receive the guide posts of the lower portion, and a coil spring between the upper and lower portions.

3. The system as set forth in claim 2 wherein the support bar has threaded projections at its upper and lower ends for coupling to the base and the lower portion.

4. The system as set forth in claim 2 and further including a second support bar having a smaller radius and height as compared to the central support bar coupled to the base adjacent to the edge.

* * * * *